United States Patent [19]

Mayer

[11] Patent Number: 4,811,571

[45] Date of Patent: Mar. 14, 1989

[54] REFRIGERANT DRIER

[75] Inventor: Donald K. Mayer, Bloomington, Minn.

[73] Assignee: Thermo King Corporation, Minneapolis, Minn.

[21] Appl. No.: 173,911

[22] Filed: Mar. 28, 1988

[51] Int. Cl.[4] ..... F25B 43/00

[52] U.S. Cl. ..... 62/474; 210/DIG. 6

[58] Field of Search ..... 62/474, 475; 210/DIG. 6

[56] References Cited

U.S. PATENT DOCUMENTS

| | | | |
|---|---|---|---|
| 2,750,041 | 6/1956 | Meyer | 210/DIG. 6 |
| 3,545,227 | 12/1970 | Grahl | 62/474 |
| 4,177,145 | 12/1979 | Schumacher | 210/DIG. 6 |
| 4,209,401 | 6/1980 | Henton | 210/DIG. 6 |
| 4,255,940 | 3/1981 | Grahl et al. | 62/474 |
| 4,266,408 | 5/1981 | Krause | 62/474 |
| 4,331,001 | 5/1982 | Jones | 62/474 |
| 4,354,362 | 10/1982 | Schumacher et al. | 62/474 |
| 4,436,623 | 3/1984 | Cullen et al. | 210/DIG. 6 |

*Primary Examiner*—Ronald C. Capossela
*Attorney, Agent, or Firm*—D. R. Lackey

[57] ABSTRACT

A refrigerant drier constructed to maintain compression of a desiccant to reduce the formation of refrigerant contaminating dust caused by attrition of the desiccant when the drier is used in applications subject to vibration. The desiccant is maintained in compression by a compression spring and barbed spring follower. Composite laminated filters are disposed adjacent to each end of the desiccant, with each composite filter including a fiberglass filter pad, which has excellent filtration characteristics for preventing any attrition dust which is generated from leaving either end of the drier. Each composite filter also includes a filter pad selected for durability which is disposed immediately adjacent to the desiccant, to cushion and protect the fragile fiberglass from aggressive action by the dessiccant. Annular perimeter rings are disposed between the dessicant and the composite filters to prevent desiccant migration past the outer perimeters of the composite filters.

11 Claims, 2 Drawing Sheets

REFRIGERANT DRIER

BACKGROUND OF THE INVENTION

1. Field of the Invention

The invention relates to refrigerant dehydrators or driers which remove moisture from the refrigerant in a refrigeration system.

2. Description of the Prior Art

The desiccant used in refrigerant driers is usually a molecular sieve because of its superior moisture adsorption capacity. A molecular sieve is a crystalline aluminosilicate material, chemically similar to clays and feldspars, belonging to a class of minerals known as zeolites. The molecular sieve is used in the form of beads which have been pelletized with a limited quantity of clay binder. While molecular sieve desiccants are superior to other desiccants from a moisture adsorption viewpoint, they do not have the best attrition strength. Laboratory tests have confirmed field reports that abrasive dust from drier desiccant can cause compressor wear. Analysis of desiccant attrition in a severe vibration environment, such as the environment of transport refrigeration units, has revealed the need for improvement in the design of refrigerant driers. It is the object of the present invention to provide a new and improved refrigerant drier construction which will survive structural vibration without disintegration of the desiccant and ingestion of the attrition powder into the refrigerant stream.

SUMMARY OF THE INVENTION

Briefly, the present invention is a new and improved refrigerant drier which reduces the amount of attrition dust by maintaining compression of the desiccant bed via a compression spring and a barbed spring follower. Two-stage composite filter pads are disposed at each end of the desiccant bed, with one stage being selected for superior filtration of any attrition dust that is generated, and the other stage being selected to cushion the superior stage from the aggressive action of the desiccant beads. Migration of desiccant beads past the outer perimeter of the filters, which can occur under conditions of severe vibration, is reduced by placement of annular perimeter rings between the desiccant bed and each of the composite filters.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
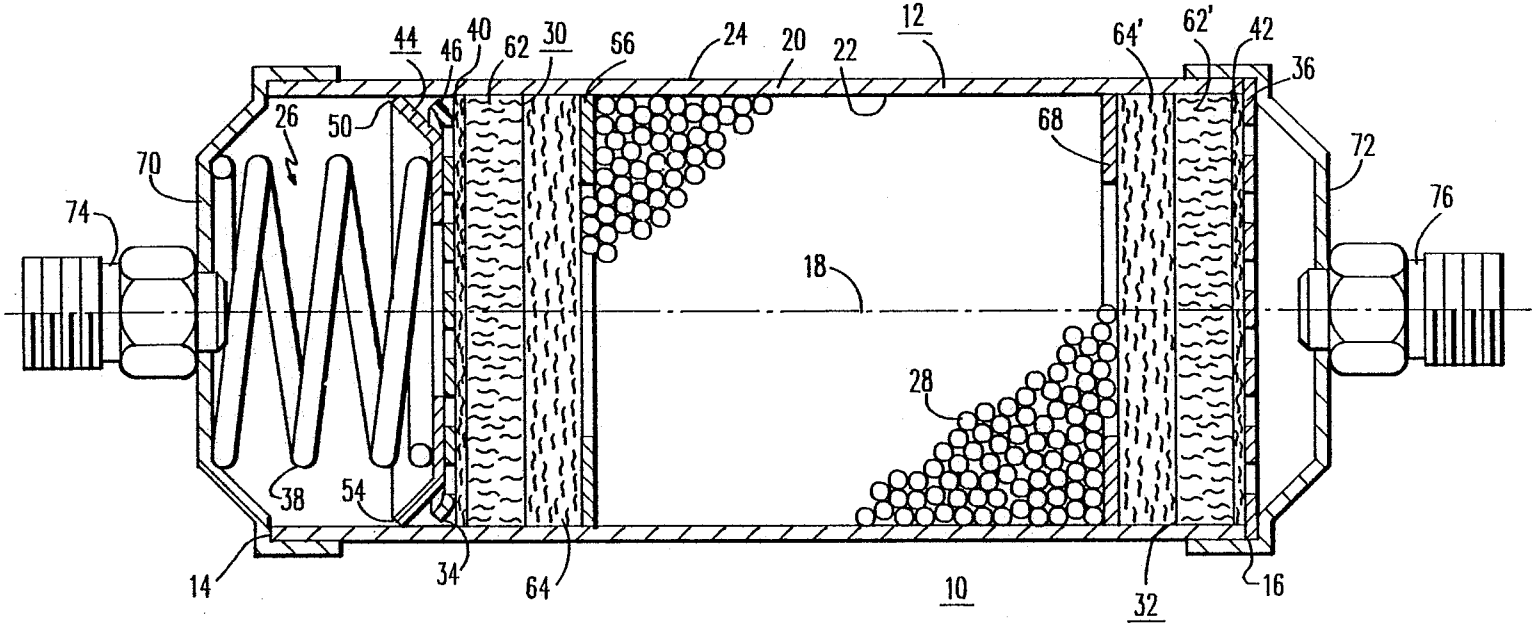
FIG. 1 is an elevational view, in section, of a refrigerant drier constructed according to the teachings of the invention.
Figure 2:
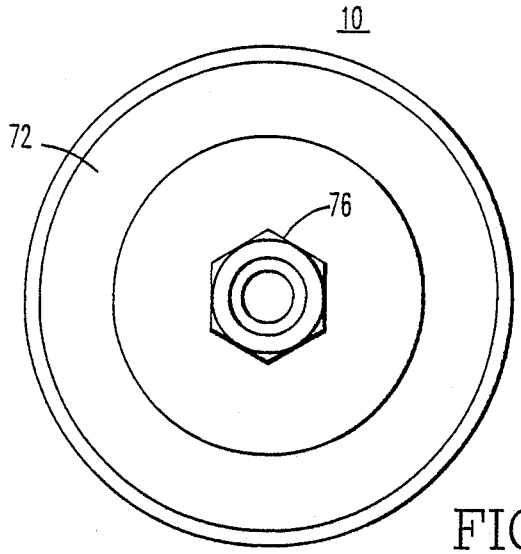
FIG. 2 is an end view of the refrigerant drier shown in FIG. 1.

Referring now to the drawings, FIG. 1 is a cross-sectional view of a refrigerant drier 10 constructed according to the teachings of the invention, and FIG. 2 is an end view thereof. Drier 10 includes a generally cylindrical, tubular metallic body member 12 having first and second ends 14 and 16, respectively, a longitudinal axis 18 which extends between its ends, a wall 20 defined by inner and outer surfaces 22 and 24, respectively, which are symmetrical about longitudinal axis 18, and an opening 26 defined by inner surface 22.

A desiccant bead bed 28 is disposed within body member 12, with the invention being primarily directed to the way the desiccant bead bed 28 is contained. As hereinbefore stated, a bead bed formed of molecular sieve beads which have been pelletized with a limited quantity of clay binder is the preferred desiccant because of its excellent moisture adsorption capacity.

In general, the desiccant bead bed 28 is contained between first and second filter pad assemblies 30 and 32, respectively, which prevent attrition dust generated in the bead bed 28 from leaving either end of the drier 10. The resulting sandwich assembly of the bead bed 28 and filters 30 and 32 is compressed between first and second perforated metallic support plates 34 and 36, respectively, and by a compression spring 38. First and second woven wire screens 40 and 42, respectively, interface the filter assemblies 30 and 32 with the support plates 34 and 36, respectively, to maintain the integrity of the filter pad surface which contacts the perforated support plate.

It is important that the resulting sandwich assembly be tightly compressed by spring 38, as a loose bead bed 28 can allow damaging bead agitation with eventual attrition by the abrasion of adjacent beads, especially when the drier 10 is subjected to a vibrating environment. Initial compression at the time of assembly is not sufficient, as the initial dimension of the bead bed 28 changes during usage when subjected to continuous vibration, even when the initial bed is vibrated during assembly. For example, an initial bead bed axial dimension of four inches can become as little as three inches with time, causing the spring to provide insufficient spring force. When spring force is insufficient in a vibrating environment, the support disc "floats", and has actually been found to pivot 90 degrees so its plane is parallel with the axis 18. When spring force is reduced or released, the bead bed 28 loses stability and extensive .desiccant attrition typically follows.

The present invention prevents loss of compression, even if the spring eventually weakens, by providing a barbed spring follower 44. The second perforated support plate 36 is fixed at the second end of body member 12, while the first perforated support plate 34 is dimensioned to axially slide snugly but smoothly within the opening 26. The outer periphery of the first support plate 34 may be turned to form a flange 46 which extends towards the first axial end 14 of body member 12 with diametral clearance to permit free axial movement, while increasing the axial dimension of the support plate 34 to provide improved sliding stability. The barbed spring follower 44 is disposed between spring 38 and the first support plate 34.

Figure 3:
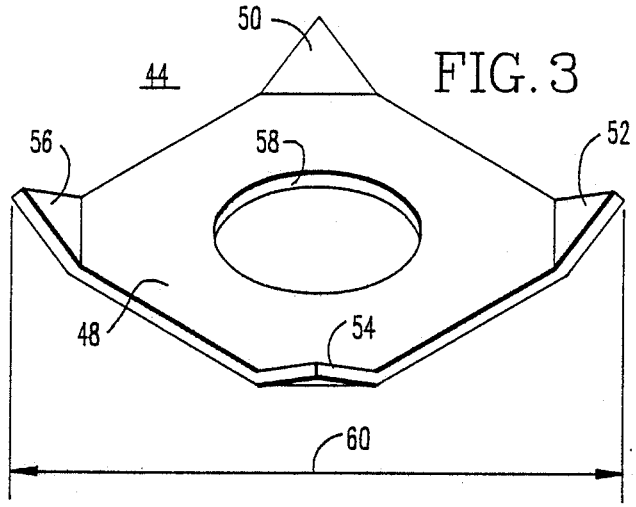
FIG. 3 is a perspective view of a barbed spring follower used in the refrigerant drier shown in FIGS. 1 and 2, along with a compression spring, to maintain compression of a desiccant bed, even under severe vibration environments.

Barbed spring follower 44, which is shown in perspective in FIG. 3, is constructed from a relatively thin sheet 48 of hardened steel, phosphor bronze, or similar flat spring material. At least three uniformly spaced sharp barbs are formed on the periphery of sheet 48, with four barbs 50, 52, 54 and 56 being shown for purposes of example. Since refrigerant must pass through spring follower 44 without restriction, a relatively large central opening 58 is provided therein. Additional flow area may be provided by forming spring follower 44 from a perforated sheet of flat spring material. Dimension 60 between oppositely disposed barbs is selected such that it is slightly larger than the inside diameter of body member 12. Thus, when spring follower 44 is oriented as illustrated in FIG. 1, with the barbs 50, 52, 54 and 56 extending towards the first end 14 of body member 12, spring follower 44 will slide in the direction of the second end 16 of body member 12 under the urging of spring 38. Spring follower 44, however, will resist a force which would tend to move it back towards the first end 14 of body member 12, by digging into the inner wall 22. Thus, the barbed spring follower 44 will maintain the smallest dimension between the first and second support plates 34 and 36 ever provided by spring 38. Support plate 34 will never be allowed to "float" regardless of the amount of reduction in spring force over a period of time. Since the desiccant bead bed 28 will be tightly compressed over the useful life of drier 10, the amount of dust generated by bead bed attrition will be significantly reduced compared with a spring loaded bead bed whose compression at any instant depends upon the presently existing spring force.

Vibration tests have demonstrated that filters constructed of wool felt, or filters constructed of a synthetic material, such as a polyester, are more durable than the frangible or friable fiberglas filter pads which are typically used. However, the filtration effectiveness of a fiberglas filter pad is superior to the polyester filter pads observed to date. The present invention provides filter assemblies 30 and 32 in the form of a composite, laminated structure which provides two filter stages. Since the filter assemblies 30 and 32 are of like construction, only the first filter assembly 30 will be described in detail.

The first filter assembly 30 includes first and second stages 62 and 64. The first stage 62 is constructed of a material selected primarily for its filtration effectiveness, such as fiberglas, which stage is disposed against the woven wire screen 40. The second stage 64 is constructed of a material selected primarily for durability, rather than filtration effectiveness, such as a synthetic material, e.g., a polyester. The second stage of the composite structure is disposed against the desiccant bead bed 28. Thus, the more durable second stage 64 serves as a cushion to protect the more fragile fiberglas from the "aggressive" action of the beads in the bead bed 28, while simultaneously providing a first filtration stage. The first filter stage 62 provides a second and more highly effective filtration stage which is thus a contingency barrier in preventing any possible attrition dust generated in the bead bed 28 from leaving either end of drier 10. The two stages of the second filter assembly 32 are given the same reference numerals as the corresponding stages of the first filter assembly 30, with the addition of a prime mark.

Under severe vibration, there is a tendency for desiccant bead migration past the outer perimeter of the filter pad assemblies 30 and 32, along the inner wall 22 of body member 12. This migration has been observed with both fiberglas and polyester filter pads. This behavior appears to be dee to both a "convenient leakage path" and the "ratchet action" from the vibrating wall 20 of body member 12. The present invention reduces desiccant bead migration by disposing first and second flat annular perimeter rings 66 and 68 at the ends of the desiccant bead bed 28. The perimeter rings 66 and 68 are washer shaped to prevent flow restriction, with their outer diameters being selected for a snug but slidable fit within opening 26, to allow them to slide axially as spring 38 compresses the entire axial sandwich. These perimeter rings effectively block the outer perimeter leakage path around the edges of the filter assemblies 30 and 32, without offering any significant fluid flow resistance. Perimeter rings 66 and 68 may be die-cut or stamped from thin compressed fiberboard, or similar economical material.

Refrigerant drier 10 is completed by securing first and second end caps 70 and 72 to the first and second ends 14 and 16, respectively, such as by welding. The first end cap 70 also functions as a spring seat for spring 38, and the second end cap 72 securely fixes the second perforated support plate 36 to the second axial end 16 of body member 12.

First and second flare fittings 74 and 76 are fastened in central openings formed in the first and second end caps 70 and 72, respectively, for attaching drier 10 in a refrigeration system.

In summary, there has been disclosed a new and improved refrigerant drier 10 which will operate in an environment subject to continuous vibration, such as in a transport refrigeration system installed on trucks and trailers. Refrigerant drier 10 maintains compression of the bead bed over the useful life of the drier, reducing the generation of bead dust in the desiccant bead bed, and it contains any bead dust that is generated by a new two stage filter assembly at each end of the bead bed. Refrigerant drier 10 also reduces desiccant bead migration past by the edges of the filter assemblies by annular perimeter rings disposed at each end of the desiccant bead bed, between the bead bed and the filter assemblies.

I claim as my invention:

1. A refrigerant drier comprising:

a generally cylindrical, tubular body member having a wall defined by inner and outer surfaces which are symmetrical about a longitudinal axis, and first and second axial ends adapted for connection in a refrigeration system, first and second perforated support plates disposed in spaced parallel relation in said body member, transverse to the longitudinal axis of said body member, said first support plate being axially slidable within said body member, in close proximity to said inner surface, said second support plate being fixed, desiccant material in said body member, between said first and second support plates, spring means urging said slidable first support plate towards said fixed second support plate, to maintain said desiccant material in compression, and means allowing said slidable first support plate to move axially towards said second support plate in response to urging by said spring means, while preventing movement of said first support plate in the opposite axial direction, to maintain the desiccant material in compression and reduce the generation of refrigerant contaminating dust caused by the attrition of the desiccant material when vibrated.

2. The drier of claim 1 wherein the first and second support plates are adjacent to the first and second ends, respectively, of the body member, and wherein the spring means is disposed between the first end of the body member and the first support plate.

3. The drier of claim 1 wherein the means which allows axial movement of the first support plate in only one axial direction is an annular metallic barbed disc, said metallic barbed disc having a plurality of circumferentially spaced barbs in contact with the inner wall and angled such that the barbs will slide on the inner wall when the barbed disc is urged in one axial direction, and such that the barbs will dig into the inner wall when the barbed disc is urged in the opposite axial direction.

4. The drier of claim 1 including first and second filter means disposed adjacent to the first and second support plates, respectively, between the first and second support plates and the desiccant material.

5. The drier of claim 4 including first and second wire screens respectively disposed between the first support plate and the first filter means, and between the second support plate and the second filter means.

6. The drier of claim 4 including first and second axially slidable annular sealing means respectively disposed between the first filter means and the desiccant material, and between the second filter means and the dessicant material, to prevent migration of the desiccant material through the interfaces between the first and second filter means and the inner wall of the body member.

7. The drier of claim 6 wherein the first and second annular sealing means are washer-shaped rings.

8. The drier of claim 1 wherein each of the first and second filter means includes a fiber cushion pad selected for durability disposed adjacent to the desiccant material and a fiberglas filter pad disposed adjacent to a support plate.

9. The drier of claim 8 wherein the fiber cushion pad includes fibers formed of polyester.

10. The drier of claim 8 wherein the fiber cushion pad is a wool felt.

11. The drier of claim 8 including first and second wire screens respectively disposed between the first support plate and the fiberglas filter of the first filter means, and between the second support plate and the fiberglas filter of the second filter means.

* * * * *